United States Patent [19]

Pauliukonis

[11] 4,114,515

[45] Sep. 19, 1978

[54] ADJUSTABLE SELF-RECIPROCATING OPERATOR

[76] Inventor: Richard S. Pauliukonis, 6660 Greenbriar Dr., Cleveland, Ohio 44130

[21] Appl. No.: 701,616

[22] Filed: Jul. 1, 1976

Related U.S. Application Data

[63] Continuation-in-part of Ser. No. 600,515, Jul. 30, 1975.

[51] Int. Cl.[2] ..... F01L 25/06

[52] U.S. Cl. ..... 91/284; 91/308; 91/309; 91/311; 91/318; 137/102; 137/624.14

[58] Field of Search ..... 91/318, 308, 311, 309, 91/284; 137/624.14, 102

[56] References Cited

U.S. PATENT DOCUMENTS

| | | | |
|---|---|---|---|
| 1,952,690 | 3/1934 | Strom, Sr. | 91/318 |
| 2,698,517 | 1/1955 | Witt | 91/318 |
| 2,707,940 | 5/1955 | Harris | 91/318 |
| 3,380,348 | 4/1968 | Kroffke | 91/318 |

FOREIGN PATENT DOCUMENTS

| | | | |
|---|---|---|---|
| 846,860 | 8/1960 | United Kingdom | 91/318 |

*Primary Examiner*—Paul E. Maslousky
*Attorney, Agent, or Firm*—R. S. Pauliukonis

[57] ABSTRACT

Automatically Self-Reciprocating sequencing valve for use with pneumatic power cylinders/actuators in systems operated at frequencies of a few cycles to a few thousand cycles per minute comprises a valve housing with a central bore adaptable to receive a shuttle member that makes or breaks fluid communication between a fluid supply source and a receiver such as a power cylinder or an actuator of a positive displacement pump in response to fluid pressures acting over surfaces such shuttle member entails as controlled by appropriate slave valve housed alongside therein including fluid supply and exhaust ports entering and leaving said valve housing, and together with said slave valve allowing an automatic reciprocating-valve-operation for as long as the pressurized fluid is supplied thereto to result in self-reciprocating operator responsive to not only system pressures for cycle regulation but also to an externally provided biasing flow regulator for an easy control of cycle frequencies within the desired practical limitations, be it a few cycles per minute or a few thousand cycles per minute.

5 Claims, 4 Drawing Figures

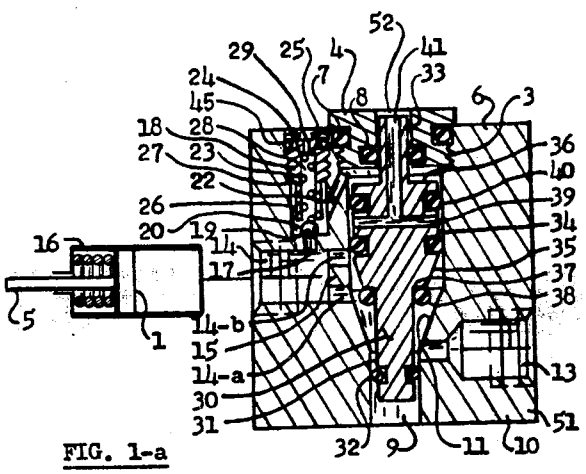
FIG. 1-a
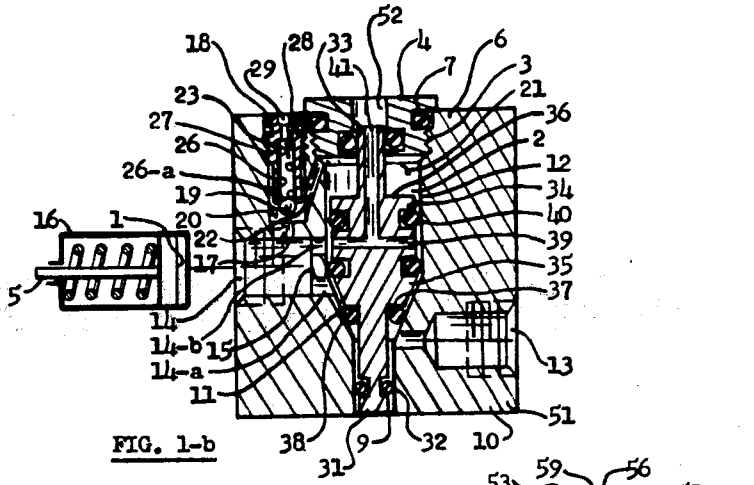
FIG. 1-b
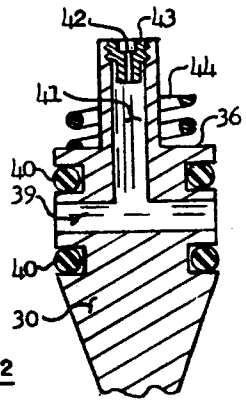
FIG. 2
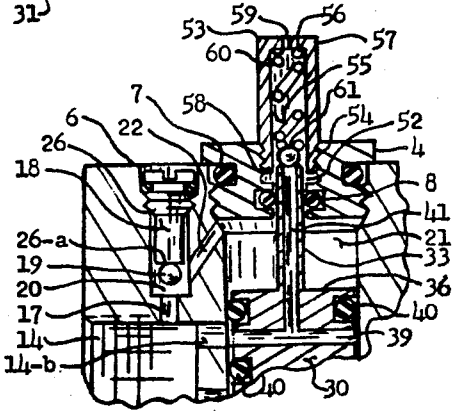
FIG. 3

ADJUSTABLE SELF-RECIPROCATING OPERATOR

This is a continuation in part of my copending application Ser. No. 600,515 filed July 30, 1975.

This invention relates to fluid power control valves, and more particularly, to a valve operator capable of automatic fluid control from a supply source to a receiver such as an actuator of a reciprocating piston type or a receptacle or a chamber in which pressure of fluid builds up to a value sufficient to trip the valve in order to initiate fluid exhaust at the end of which operator returns to the original position automatically to repeat the cycle at certain predetermined frequency, with capability of sequency adjustment within a given range of pressures and cycles when feeding and exhausting receivers.

An automatic operation of self-reciprocating valves capable of adjustment of frequency has not been practically accomplished by operators of prior art, in particular those used with pressurized fluids wherein the fluid pressure alone causes such valve response to operating pressures. A search of patents in existance failed to uncover capabilities offered by this invention. Patents covering similar devices in this class, subject to review were: U.S. Pat. Nos. 932,887 by McDaniel, 2,316,445 by Marshall, 2,441,201 by Ludwig, 2,593,039 by Livers et al, 2,923,576 by Seale, 3,183,919 by Herring 3,326,236 by Beckett et al, 3,570,523 by Pauliukonis and 3,572,362 by Pauliukonis. All of the patented devices of the prior art fail to provide "tapered valve with conical seat" covered by copending application listed above, serving as basis for this invention in terms of fundamental improvements in valve capability to reciprocate safely during extended service life while less strained loadwise, let alone other design and control differences that separate this invention from prior art.

The general object of the invention is to provide a valve operator which renders the operator reliably responsive to operating pressures built up therein for long lasting service in feeding and exhausting receivers of pressurized fluids automatically at a certain preselected cycle frequency.

Further object of the invention is to provide an operator valve which incorporates frequency adjustment means for operation at predetermined sequence irrespective of internal pressure values.

Another object of this invention is to provide a self-reciprocating sequencing valve for use with pressurized working fluids with reduced physical loading of valving means in order to extend the service duration of such valves beyond that attainable with valve operators of the prior art.

It is further object of this invention to provide fluid power industry with a valve of the character stated to facilitate availablity of adjustable self-reciprocating operator with superior performance without resorting to complicated systems and costly components.

Other objects and advantages of this invention will be apparent from the ensuing disclosure and the appendent claims.

IN THE DRAWINGS

FIGS. 1-*a* and 1-*b* show sectional view of the operator and basic components thereof including positions of tapered poppet and of slave valve incorporated therein.

FIG. 2 identifies poppet section enlarged including exhaust orifice and compression spring incorporated therein for control of cycle frequency under specific operational regime.

FIG. 3 identifies in cross-section slave valve along with biasing flow regulator as alternative combination of components for cycle control under different operating conditions.

Solely by way of example, and not by way of restriction or limitation the description of the invention will follow by reference to FIGS. 1-*a* and 1-*b*. The valve operator shown includes a housing 51 with a central bore 2 passing therethrough having a large opening 3 at first housing end 6 closed by an end cap 4 provided with external seal 7 and internal bore 52 including appropriate seal 8 while terminating with a smaller size opening 9 at second housing end 10. Interconnecting openings 3 and 9 bore 2 includes a straight bore section 12 adjacent large opening 3 at the end of which is a conical valve seat 11 adjacent smaller size opening 9. A side port 13 enters bore 2 adjacent intersection of opening 9 with a small end of valve seat 11 perpendicularly to serve as a fluid supply port. A side port 14 enters bore 2 perpendicularly by way of divided flow passages 14-*a* and 14-*b* initiating at flat bottom 15 or port 14 adjacent intersection of straight section 12 with a large end of valve seat 11, and serves as fluid receiver port, feeding and exhausting a symbolically illustrated differential reciprocating motor 16 which in FIG. 1-*a* is energized by pressurized fluid urging piston 1 with rod 5 to extend while in FIG. 1-*b* is exhausted with rod 5 retracted. The symbol of such a reciprocating differential motor 16 in practice may represent a single acting spring return power cylinder, however it should be understood that the subject invention may be used with other types of devices such as pump actuators returning by own vaccum force as newly invented and described in U.S. Pat. No. 3,815,481 and the like.

Inside port 14, adjacent flat bottom thereof, a perpendicular opening 17 initiates to feed a slave valve assembly 18 spaced parallel with and conveniently close to the straight bore section 12 that starts with large opening 3 at first housing end 6.

Shown in FIG. 1-*a* opening 17 is closed by a ball 19 prohibiting fluid under pressure to enter cavity 20 while in FIG. 1-*b* ball 19 is lifted from its seat allowing fluid communication between port 14 and cavity 20 and also fluid flow from cavity 20 into cavity 21 via opening of pilot port 22 shown therein on an angle. Ball 19 may be replaced by other sealing means, spring loaded by a compression spring 23 doubling as frequency control means 5 capable of holding ball 19 firmly seated over opening 17 while being backed up at the opposite spring end 24 by a shoulder 25 of adjustably movable axially a slave valve assembly barrel 26 to insure spring force adjustment and an inherent frequency control when fluid pressures differ, with capability of being depressed by a given fluid pressure entering receiver such as reciprocating 16 shown when such receiver pressure builds up therein first to complete extension of rod 5 as shown in FIG.1-*a* and subsequently to trip the ball 19, or similar other sealing means thereof, in order to pressurize, via pilot port 22, cavity 21 for an automatic cut-off of fluid pressure fed to the receiver motor 16. This takes place when bore 2 slidably receives a poppet 30 of alongated configuration having a first reduced diameter end 31 provided with a seal 32 to enter smaller size opening 9 adjacent second housing end 10 while the opposite second reduced poppet end 33 of a diameter slightly less than the diameter of end 31 is slidably received inside internal bore 52 of end cap 4 provided with a seal 8. Then, an interconnecting poppet-central section of larger diameter than the ends, comprising a straight portion 34 of a diameter slightly less than the diameter of straight bore section 12 adjacent end 33, gets slidably received inside bore section 12 so as to have its tapered end 35, of an angle identical to the angle of conical valve seat 11, adjacent first end 31, to either bottom conical valve seat 11 as shown in FIG.1-*b* when pressure acts over poppet shoulder 36 at end 33, formed against the straight portion 34, after entering cavity 21, or be lifted from valve seat 11 as shown in FIG. 1-*a* when cavity 21 is open to exhaust, and as such, becoming atmospheric while pressure entering port 13 predominates over poppet shoulder 37 at end 31, formed against tapered end 35 which also includes a seal 38.

It should be noted that when poppet 30 is in position as shown in FIG. 1-*b*, working fluid under pressure entering side port 13 is restricted from further flow thereto by seals 32 and 38 for as long as cavity 21 is under pressure. This is only possible in conjunction with operation of slave valve assembly 18.

Turning back to the description of slave valve assembly 18 of FIGS. 1-*a* and 1-*b*, we find that the housing 51 is provided with a threaded counterbore 27 entering housing partway in parallel with bore 2 and adaptable to receive barrel 26 with seal 45 so as to enable, through threaded connection, adjustment of spring 23 housed inside barrel bore 28 for a desired operational cycle frequency within given system pressure and to permit also evacuation of cavity 20 when spring 23 exerts force over ball 19 larger than the opposing fluid pressure force prevalent inside port 14, simultaneously acting over it through the opening 17. As FIG. 1-*a* shows, cavity 20 is open to atmosphere by way of an opening 29 at the end of barrel bore 28 allowing a simultaneous and complete exhaust of cavity 21 communicating with cavity 20 via pilot port 22. Because of no pressure in cavity 21, the poppet 30 becomes lifted from the valve seat 11 rendering operator valve open for fluid communication between ports 13 and 14 and full blast of pressurized fluid via passages 14-*a* and 14-*b* to feed receiver 16 and to extend piston rod 5 performing useful work therewith until such fluid builds up pressure therein at the end of stroke so as to also unseat ball 19 against spring 23 with a force large enough to essentially move ball 19 against barrel mouth 26-*a* facing cavity 20 thereby closing atmospheric exhaust of cavity 20 while the pressure persists forcing ball 19 to maintain seat inside mouth 26-*a*, and rendering pressurization not only of cavity 20 but instantaneously pressurizing also cavity 21. Because poppet end 33 is slightly smaller than poppet end 31, an end force over shoulder 36 larger than over shoulder 37 results in poppet shift from the position shown in FIG. 1-*a* to FIG.1-*b*, automatically reversing the cycle from receiver feeding to a receiver exhausting when poppet 30 engages seat 11 to stop further influx of pressurized working fluid and fluid flow from port 13 to port 14. FIG. 1-*b* shows cavity 21 under pressure along with cavity 20, and poppet 30 seated so as to enable receiver 16 exhaust via flow passage 14-*b*, lined up with poppet exhaust passages 39 across center of section 34 protected by a pair of radial seals 40, and out through an interconnecting vertical passage 41 inside poppet end 33 into the atmosphere until the pressure becomes evacuated not only from the receiver 16 which retracts but also from cavities 20 and 21 through the same exhaust port means described, enabling return of ball 19 over the opening 17 for sealing it off, and for subsequent cycle repetition automatically from that shown in FIG.1-*b* to that shown in FIG.1-*a*, feeding and exhausting receiver 16 at a given cycle frequency time and again, in a precise and repeated sequence of operation, unless changed if and when desired through adjustment of frequency as provided. FIG. 2 identifies other means for such cycle frequency change that were experimentally defined through adaptation of this operator to various receiver sizes. Specifically, FIG. 2 identifies enlarged section of poppet 30 with cross passage 39 protected by seals 40 in communication with vertical exhaust passage 41 including orifice 42 inside plug 43 at the end 33 over which a spring 44 is located over the shoulder 36. It was found that in order to serve very small receivers such as miniature power cylinders, capable of spring return, valve components such as poppet 30 as well as passages thereof for fluid exhaust need a drastic size reduction, unless either spring 44 is used to aid poppet return or orifice 42 inside plug 43 or both are used, in order to slow down exhaust while pressure in cavity 21 builds a force larger than the opposing end force over shoulder 37, enabling thereby a poppet shift for a position change from that shown in FIG.1-*a* to that of FIG. 1-*b*. With meager volumetric capacity of small power cylinders there is otherwise insufficient time left to maintain sequence of the cycle at fixed frequency, occasionally leading to starvation of the poppet shuttling inside bore 2 without added resistance to exhaust, offered by orifice 42 of FIG. 2. In particular important is the addition of spring 44 to poppet 30 when converting a given large capacity operator valve to control off-sized receiver operation in a self-reciprocating automatic sequence as this, along with replaceable plug 43 with orifices 42 of different sizes, provides simplest means of converting operator from one capacity to another with ease or even to drastically change cycle frequency thereof when needed.

FIG. 3 shows alternate combination of components for cycle frequency control yielding more dramatic results during experimentation in that it offered external control means for finger-tip adjustment rather than internal control means identified while describing FIG. 2 above. FIG. 3 in essence is a cut out of valve portion from that shown in FIG.1-*b* and not FIG.1-*a*, which identifies the first housing end 6 closed by cap 4 provided with external seal 7 and internal bore 52 including appropriate seal 8 along with enlarged view in cross section of slave valve assembly 18 of which ball 19 is seated inside mouth 26-*a* of barrel 26 indicating that cavities 20 and 21 are under pressure of fluid fed from port 14 via opening 17 and port 22 to exert over shoulder 36 of poppet 30 a force sufficient for holding poppet exhaust passages 39 in line with exhaust flow passage 14-*b* from port 14 to exhaust into the atmosphere through vertical passage 41 of poppet end 33, in accordance with the preceding description of FIG.1-*b*.

Fingertip adjustment of cycle frequencies is made through biasing flow regulator 53 inside cap 4 provided with new set of threads 54 shown in FIG. 3 as an additional feature of this design modification. As shown in FIG. 3, a regulator housing 57, having threads to correspond to threads 54 at a first end 58, with open bore 55 which is closed by an end wall 56 at a second opposite housing end, includes a fluid exhaust port 59 substantially in line with and on the same axis as the exhaust passage 41 of poppet end 33. This enables central mounting of a regulator biasing spring 60 which in FIG. 3 includes a ball 61 snuggly seated over exhaust passage 41 of the poppet end 33 exerting a certain spring force over it, depending on the location of the regulator housing 57 inside threads 54, subject to fingetip adjustment therein. When compared with FIG. 2 arrangement which identifies orifice 42 inside plug 43 at end 33 of the poppet 30 and a compression spring 44 at the poppet shoulder 36, both of which are used for control of cycle frequency and regulation of operational sequence, in FIG. 3 we find equivalent parts identified by ball 61 and spring 60. Instead of plug 43 of FIG. 2 ball 61 is used to provide additional flow resistance when called for, unless exhaust passage 41 is sized for required outflow capacity in which case spring alone will serve as means of frequency regulation except that in FIG. 3 it is done externally while the same function in FIG. 2 occurs internally. Placing regulator exhaust port 59 in line with exhaust passage 41 of poppet end 33 is incidental as the operation will not be affected in any way or fashion if such an exhaust were placed anywhere therein as long as spring 60 abuts poppet end 33 either through a ball 61 or directly. In fact, an elongated industrial muffler having a multiplicity of minute ports in the housing 57 which in mufflers is made from sintered metal, served ideally the purpose without effect to the adjustment or operation of this adjustable self-reciprocating valve operator.

While the description above identified valve operator of the single acting type, also known as three-way valve by way of example, double acting type operator also known as four-way valve is nothing more than added back to back two such three-way valves together. The present invention therefore is applicable to single acting and double acting applications as well in accordance with the description, satisfying the objectives outlined in the invention summary in all respects.

It is understood that variations, changes and modifications may be made in the structural details of the device, within the scope of the appended claims, without departing from the spirit of the invention.

What is claimed is:

1. An adjustable self-reciprocating valve comprising:

a valve housing including a central shuttle valve means therein and a slave valve means housed alongside thereof, a differential valve member having small and large fluid responsive surfaces in opposition to each other in said shuttle valve means, said differential valve member also having a cycle frequency control means including an adjustable biasing force means for regulating and adjusting said slave valve means, a working fluid supply and first exhaust means in said valve housing, said slave valve means further including a pressurized cavity fluid delivered by said working fluid for said shuttle valve means, a second separate exhaust means for said cavity fluid from said slave valve means, said slave valve means triggering and controlling an automatic reciprocation of said shuttle valve means when subjected to fluid pressure, at least a pair of side ports in said valve housing entering said shuttle valve means and a first of said ports supplying working fluid thereto comprising said working fluid supply means while a second of said ports leading to a receiver thereof, a perpendicular opening inside said second side port to feed said slave valve means with said cavity fluid when said receiver pressure builds up to a value sufficient to perform useful work therein and also to trip said slave valve means in order to initiate operation of said shuttle valve automatically, means for fluid communication between fluid supply source and said receiver such as a power cylinder provided with a piston including means for piston return requiring the supply and exhaust of the working fluid in a sequence in order to sustain a specific cycle frequency of said piston within the desired operational limitations such as a few cycles per minute including a few thousands cycles per minute, and a sequential fluid exhaust from said receiver via said first fluid exhaust means to facilitate subsequent exhaust of said cavity fluid from said slave valve means at the end of each piston cycle.

2. An adjustable self-reciprocating valve operator as in claim 1 wherein said valve housing includes a bore passing substantially through a center thereof, said bore including a first large bore opening, covered by an end cap having own central bore passing therethrough, entering said housing bore inwardly partway from a first housing end toward a second housing end, and an opposite second small bore opening, of a diameter slightly larger than the diameter of said central bore of said end cap, entering said housing bore inwardly partway from a second housing end toward a first housing end, an interconnecting bore section therebetween including a straight section of a diameter larger than the diameter of said second small bore opening, at the end of said first large bore opening, terminating with a conical valve seat tapering down for blending-in with said second small bore opening adjacent said second valve housing end, said valve shuttle member received inside said housing bore slidably so as to have a first smallest diameter end of a sliding fit with said central bore of said end cap, an opposite second reduced diameter end of a sliding fit with said second small bore opening of said second housing end, and an intermediate section of a sliding fit with said straight section of said housing bore, ending with a tapered poppet, an angle of which equals the angle of said conical valve seat and together therewith comprising said central shuttle valve means thereof, at least a pair of seals at the extremities of said straight section of said valve shuttle member including an exhaust passage therebetween connected to an exhaust discharge in said first end sliding inside said central bore of said end cap, a first cavity in said housing bore subject to a volumetric change, formed between said straight bore section and said first smallest diameter end of said valve shuttle member adjacent said end cap when said tapered poppet engages said conical valve seat to render said central shuttle valve means closed, said housing further including a second cavity formed therein by a counterbore spaced a distance away from said central bore to enter said housing partway substantially in parallel therewith for a communication with said perpendicular opening inside said second side port to feed said slave valve means, a fluid passage means via a pilot port between said first and second cavities, said slave valve means including a slave valve assembly and means for adjusting actuation thereof including said second means for fluid exhaust therefrom and an evacuation of said cavities when said slave valve assembly disconnects said perpendicular opening inside said second side port at the end of a pressure reduction in said receiver exhausting via said exhaust passage of said shuttle valve member to allow a subsequent evacuation of said cavities and a cycle repetition by receiver repressurization via said side ports until pressure inside said receiver at the end of useful sequential cycle trips said slave valve means disconnecting cavity exhaust for subsequent repressurization of said cavities in order to automatically disconnect further supply of fluid to said receiver when said first cavity becomes energized by fluid pressure forcing said poppet to engage said conical valve seat, comprising a self-reciprocating valve operation within a certain predetermined cycle frequency as controlled by fluid pressure action over said slave valve means triggering said central shuttle valve means to shuttle therein with a continuous supply and exhaust of the pressurized working fluid to and from said receiver.

3. An adjustable self-reciprocating valve operator as in claim 2 wherein said valve shuttle member provides a differential area surfaces at said first and second ends for fluid pressure to exert a differential end force thereupon resulting in shuttling of said valve shuttle member inside said housing bore with resultant change in said first cavity subject to said volumetric change which increases when said central shuttle valve means are closed during said receiver evacuation, and then decreases when said slave valve means are open to exhaust rendering said central shuttle valve means open for repressurization of said receiver during cycle repetition while said first cavity evacuates, closing of said central shuttle valve means occurring when said first and second ends of said valve shuttle members are simultaneously exposed to the fluid pressure.

4. An adjustable self-reciprocating valve operator as in claim 1 wherein said cycle frequency control is purely pressure dependent, including internal adjustment means for frequency control thereof.

5. An adjustable self-reciprocating valve operator as in claim 1 wherein said cycle frequency control is purely pressure dependent, including external adjustment means for frequency control thereof.

* * * * *